US009450280B2

(12) United States Patent
Pruvost et al.

(10) Patent No.: US 9,450,280 B2
(45) Date of Patent: Sep. 20, 2016

(54) COPLANAR WAVEGUIDE

(71) Applicant: STMicroelectronics SA, Montrouge (FR)

(72) Inventors: Sébastien Pruvost, Froges (FR); Frederic Gianesello, Crolles (FR)

(73) Assignee: STMicroelectronics SA, Montrouge (FR)

( * ) Notice: Subject to any disclaimer, the term of this patent is extended or adjusted under 35 U.S.C. 154(b) by 160 days.

(21) Appl. No.: 14/527,249

(22) Filed: Oct. 29, 2014

(65) Prior Publication Data

US 2015/0050001 A1 Feb. 19, 2015

Related U.S. Application Data

(62) Division of application No. 13/736,913, filed on Jan. 8, 2013, now Pat. No. 8,902,025, which is a division of application No. 12/468,627, filed on May 19, 2009, now Pat. No. 8,390,401.

(30) Foreign Application Priority Data

May 19, 2008 (FR) ..... 08 53224

(51) Int. Cl.
*H01P 3/08* (2006.01)
*H01P 3/00* (2006.01)

(52) U.S. Cl.
CPC ..... *H01P 3/003* (2013.01); *H01P 3/006* (2013.01); *H01P 3/082* (2013.01)

(58) Field of Classification Search
CPC ..... H01P 3/08; H01P 3/081; H01P 3/082; H01P 3/085; H01P 3/088
USPC ..... 333/238, 246
See application file for complete search history.

(56) References Cited

U.S. PATENT DOCUMENTS

| | | | | |
|---|---|---|---|---|
| 5,408,053 | A * | 4/1995 | Young | H01P 3/088 174/262 |
| 5,561,405 | A | 10/1996 | Hoffmeister et al. | |
| 6,294,965 | B1 | 9/2001 | Merrill et al. | |
| 6,617,946 | B2 | 9/2003 | Kennedy et al. | |
| 7,102,456 | B2 | 9/2006 | Berg | |
| 8,390,401 | B2 | 3/2013 | Pruvost et al. | |
| 2001/0040490 | A1 * | 11/2001 | Tanaka | H01P 3/085 333/204 |
| 2007/0040626 | A1 | 2/2007 | Blair et al. | |
| 2008/0048796 | A1 | 2/2008 | Shaul et al. | |

FOREIGN PATENT DOCUMENTS

| | | | |
|---|---|---|---|
| EP | 0917236 | A2 | 5/1999 |
| JP | 09093005 | | 4/1997 |
| WO | WO-02103838 | A1 | 12/2002 |
| WO | WO-2007080529 | A1 | 7/2007 |

OTHER PUBLICATIONS

INPI Search Report for FR 0853224 dated Nov. 11, 2008 (3 pages).
D. Budimir, Q. H. Wang, A. A. Rezazadeh and I. D. Robertson, "V-Shaped CPW Transmission Lines for Multilayer MMICs," Electronics Letters, IEE Stevenage, GB, Oct. 26, 1995, pp. 1928-1930, vol. 31, No. 22 (3 pages).
J. L. B. Walker: "A Survey of European Activity on Coplanar Waveguide," Microwave Symposium Digest, 1993, IEEE MTT-S, pp. 693-696 (4 pages).

* cited by examiner

*Primary Examiner* — Stephen E Jones
(74) *Attorney, Agent, or Firm* — Gardere Wynne Sewell LLP

(57) ABSTRACT

A coplanar waveguide electronic device is formed on a substrate. The waveguide includes a signal ribbon and a ground plane. The signal ribbon is formed of two or more signal lines of a same level of metallization that are electrically connected together. The ground plane is formed of an electrically conducting material which includes rows of holes.

20 Claims, 3 Drawing Sheets

COPLANAR WAVEGUIDE

CROSS-REFERENCE TO RELATED APPLICATIONS

This application is a division of United States Application for U.S. Pat. No. 13/736,913 filed Jan. 8, 2013, which is a division of United States Application for U.S. Pat. No. 12/468,627 filed May 19, 2009 (now U.S. Pat. No. 8,390,401 issued Mar. 5, 2013) which claims the benefit of French Patent Application No. 0853224, filed May 19, 2008, which applications are incorporated herein by reference in their entirety.

TECHNICAL FIELD

An embodiment of the present disclosure relates to the field of passive components, particularly passive components for microwave electronic circuits such as coplanar waveguides.

Such components may be made, for example, by using the so-called silicon on insulator technology (SOI).

This manufacturing technology may be used, for example, as an alternative to crude silicon. With the use of highly resistive substrates, losses may be decreased and performance may be increased.

More specifically, an embodiment of the disclosure relates to a coplanar waveguide electronic device, able to propagate a microwave signal and comprising a substrate whereon is mounted a central signal ribbon and at least one ground plane, said central signal ribbon and said ground plane each being achieved as an assembly of at least one metallization layer, at least one metallization layer of the ground plane being able to cooperate with a same-level layer of the central signal ribbon for the propagation of the microwave signal.

SUMMARY

For the manufacture of such devices, there may exist a major constraint.

This constraint relates to the drawing rules on silicon. In fact, on silicon it is often not possible to draw solid metals beyond a certain threshold width, thus limiting the dimensions of the signal ribbon: for a given technology (65 nm, 130 nm, etc.), there exists a maximal width for the signal ribbon in full.

Beyond that, dishing problems may occur during the actual manufacture of electronic components: the layers (or levels) of metallization are mainly made of copper, "soft" material, in a frame of silicon dioxide $SiO_2$, "hard" material. If the width of a copper strip is too wide, the copper strip may become hollow or bulge, and the final structure may hence lose its flatness, and the electronic component may become defective.

Furthermore, the metallic density should be respected, i.e., that for a given technology, there exists, during the manufacture, a control window, of determined dimensions, which, when moving above the electronic device, should detect a certain quantity of metal, minimal or maximal, for example, depending on the controlled area and the type of electronic device.

An embodiment of the present disclosure remedies these drawbacks by proposing a device, which further conforms to the description given above, wherein each metallization layer of the central signal ribbon able to propagate a microwave signal comprises a plurality of individual signal lines electrically coupled together for the propagation of said microwave signal.

Thanks to this configuration, the total width covered by the plurality of individual signal lines may be greater than the maximal width that may be given to a unique individual signal line without loss of flatness.

The signal lines may be separated from each other by a minimum distance, for example, by about 0.5 μm.

The set of individual signal lines may be parallel to each other and all coupled to one higher supply layer, typically of aluminum, the drawing constraints of which typically being much less restrictive, i.e., of which the maximal width may be much greater than the possible maximal width of one single individual line.

Thanks to this multi-line configuration, the density of metal at the central ribbon may be higher than that obtained by a central ribbon comprising only one single individual signal line (perforated in order to be achievable), while respecting the drawing rules for each individual signal line.

With regard to the ground plane, in an embodiment it is made of an electrically conducting material, typically of copper, and comprises a plurality of holes.

The holes may be spread in lines parallel to the central signal ribbon, each parallel line comprising holes identical and equidistant to each other.

In an embodiment, the dimension of the holes and/or the spacing between the holes form(s) a gradient of the signal ribbon towards the periphery of the ground plane. That is, the ground plane comprises a gradient of metallic density from the central signal ribbon towards the periphery of the ground plane.

The gradient of metallic density may be decreasing from the central signal ribbon towards the periphery of the ground plane.

In an embodiment, the substrate is a high resistivity type substrate.

With this configuration, the ground plane and the central signal ribbon may comprise a plurality of metallization layers at least any one of which is used for the propagation of a microwave signal.

Alternatively, the ground plane and the central signal ribbon may comprise a plurality of metallization layers at least any two metallization layers of which are electrically coupled together for the propagation of a microwave signal.

In another embodiment, all metallization layers are electrically coupled together for the propagation of a microwave signal.

At least the farthest metallization layer from the substrate of the ground plane may cooperate with the farthest metallization layer from the substrate of the central signal ribbon for the propagation of the microwave signal.

BRIEF DESCRIPTION OF THE DRAWINGS

Characteristics and advantages of one or more embodiments of the present invention may become more apparent from the following description given as an illustrative and non-limitative example with reference to the accompanying drawings, wherein.

DETAILED DESCRIPTION

Figure 1:
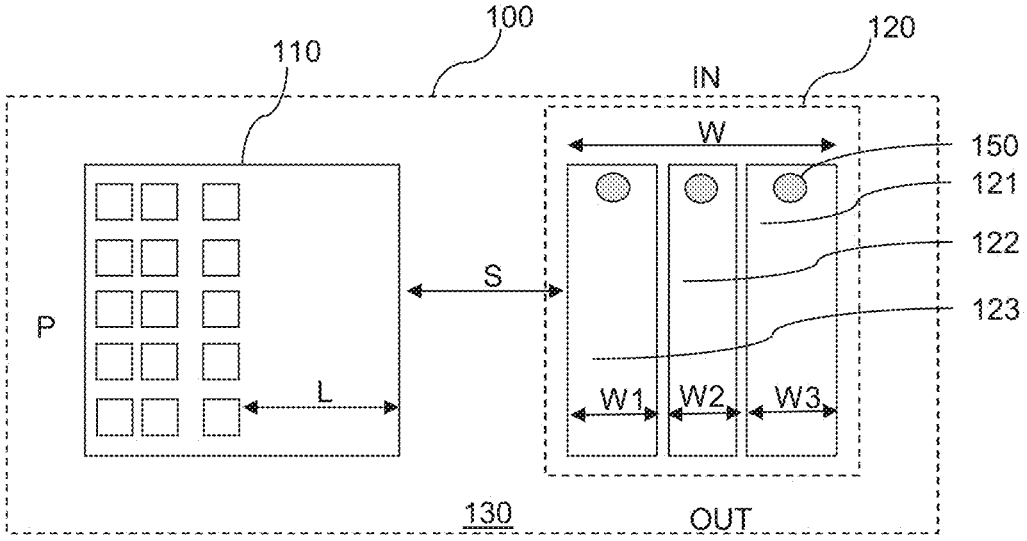
FIG. 1 shows a top view of part of the device according to an embodiment.

With reference to FIG. 1, a device 100 according to an embodiment is a coplanar waveguide comprising a high resistivity substrate 130 whereon is mounted a signal ribbon 120 and at least one ground plane 110. By high resistivity, is meant a resistivity higher than, for example, 1 KΩ/cm.

To simplify the present description, another symmetrical ground plane with respect to the central signal ribbon is not represented nor described (although it may be present), its structure being the same as that of the ground plane 110.

In an embodiment, the central signal ribbon 120 comprises a plurality of signal lines 121, 122, 123 of widths W1, W2 and W3, respectively, and achieved at the same metallization level. The respective widths W1, W2 and W3 of signal lines 121, 122, 123 can be identical or not. These signal lines are electrically coupled together, for example, through vias 150, to a higher metallization level, usually in aluminum, not shown, serving as a supply.

In the structure represented in FIG. 1, the current propagates in one direction, along the signal lines, from entry IN towards the exit OUT of the ribbon.

In an embodiment, the metallic density at the central ribbon 120 may be maximal thanks to the transmission signal lines.

The total covered area, or the total width W, of the central signal ribbon 120 may then be higher than the maximal width W1 or W2 or W3 of one single signal line.

By way of non-limiting example, in a 130 nm technology, the maximal width of a solid central ribbon (comprising only one single central signal line) of a sixth level of metal from the substrate often cannot exceed 11.99 μm, to prevent dishing.

According to an embodiment, the central signal ribbon comprises three identical signal lines, the dimensions of each signal line being W1=W2=W3=5 μm spaced apart by 0.5 μm. In this configuration, the width W of the central signal ribbon is thus of 16 μm.

In this configuration, the obtained metal density may be as high as approximately 93.75%, and the total width of ribbon W may then be higher than the maximal width of one single signal line, i.e., higher than the maximal width that the ribbon could have should it comprise one single signal line.

Thanks to this configuration, the resistance of the ribbon decreases, thus increasing the performance of the electronic component.

Another embodiment of the invention relates to the ground plane 110.

A ground plane 110 is separated from the central signal ribbon 120 by a slit of width S.

For a microwave signal to propagate properly, a specific metallic density should also be, or approximately be, obtained at the ground plane.

At the ground plane, the propagation mode is thus not unidirectional as in the central signal ribbon, but the current may propagate perpendicularly to the propagation direction of a signal line. Thus, with this ground plane structure, the current may propagate in two orthogonal directions (parallel and orthogonal to the signal ribbon).

And if the same solution as for the central signal ribbon is used, i.e., achieving the ground plane as a plurality of lines electrically coupled together, losses may be increased. Thus, this solution may not be desirable.

According to an embodiment, the structure of the ground plane comprises a set of holes, enabling the propagation of the current in these two orthogonal directions, and making it possible to prevent the afore-mentioned dishing problems.

As a result, such a device may also undergo fewer losses at the ground.

In an embodiment, "hole" is meant a recess achieved in the metallization strip (e.g., copper or aluminum), said recess being filled with silicon dioxide SiO2.

Figure 2:
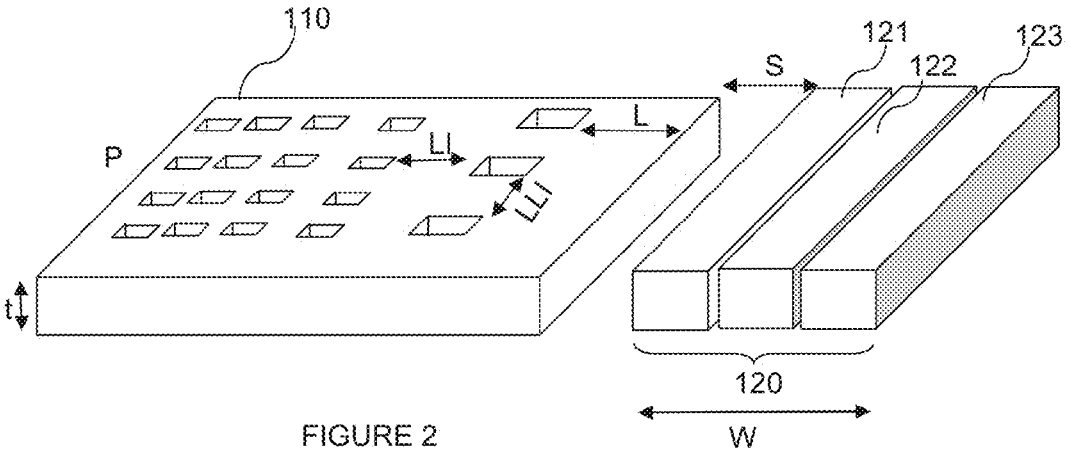
FIG. 2 shows a three-dimensional perspective view of FIGS. 1.

As shown in FIG. 1 or FIG. 2, an embodiment of the structure comprises a ground plane 110, having a full width L, free from holes, and closest to the central signal ribbon 120, and wherein a number of holes are then carried out laterally, in order to reduce its density.

In FIG. 2, the central signal ribbon 120 has a width W and may be composed of a plurality of signal lines coupled to each other, as described previously.

The number of holes and their dimension as well as their position may be defined so as to respect the rules of metallic density (in the present case, for example, in a 130 nm technology, W=3 μm, s=3 μm and L=11.99 μm).

The holes made in the ground plane may be of variable dimensions and/or spacing, but in an embodiment are identical and equally-spaced along a same line parallel to the central signal ribbon The spacing LLI between two adjacent holes of a same line may differ from one line of holes to the next.

The spacing LI between two adjacent lines of holes may also be different along the ground plane.

In this way, it may be possible to define at the ground plane a gradient at the dimension of the holes from one line of holes to the next, and/or a gradient at the spacing between the holes of a same line of holes, as well as a gradient of the spacing between two adjacent lines of holes.

In an embodiment, the spacing LLI between two adjacent holes of a same line decreases from the central strip 120 towards periphery P of the ground plane (thus, the number of holes per line increases), and the spacing LI between two adjacent lines of holes decreases from the central strip 120 towards the periphery of the ground plane.

Thanks to this configuration, the current density is the highest at the areas near the central signal ribbon 120, which may reduce the global resistance of the propagation structure (ribbon) by a better distribution of electric-field lines.

The greater the portion of the ground plane width attributed to the full width L of the ground plane near the central signal ribbon, the more the lines of the electric field are confined in this area.

The further the last line of holes from the central ribbon, the more the magnetic-effect induced losses may be limited (flattening of the magnetic field lines).

Figure 3:
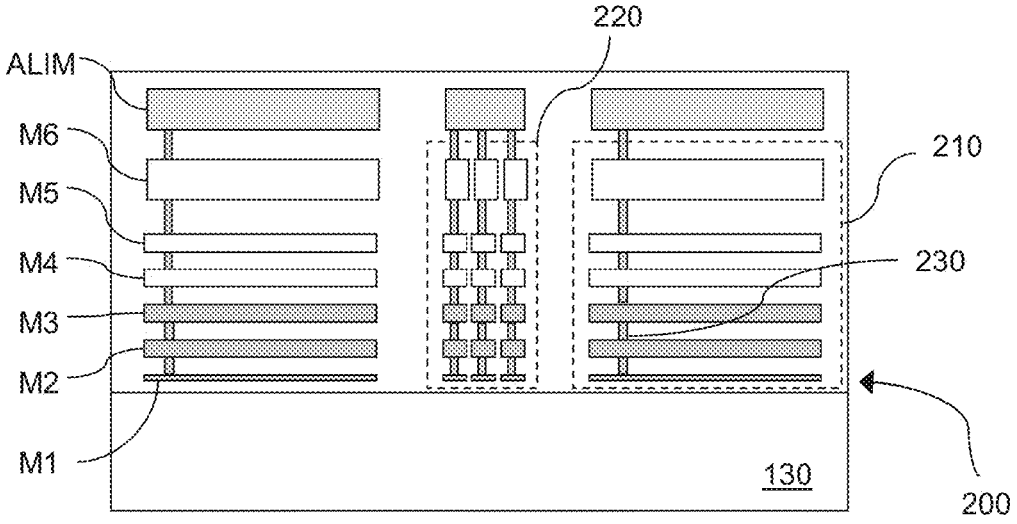
FIG. 3 shows a cross-section of an embodiment.

Furthermore, the structure of an electronic component according to an embodiment of the invention may be achieved as represented in FIG. 3.

FIG. 3 schematically represents an embodiment of a cross-section of an electronic device 200 such as a coplanar waveguide.

The coplanar waveguide 200 comprises a central signal ribbon 220. The central signal ribbon 220 may be achieved by a plurality of signal lines electrically coupled together as previously described.

Furthermore, the coplanar waveguide 200 comprises at least one ground plane 210. The ground plane 210 may be achieved as previously described.

As represented on FIG. 3, the coplanar waveguide 200 comprises a plurality of metallization layers, six in the present case, respectively M1 to M6.

The supply is ensured by an aluminum layer ALIM, which distributes the current by means, for example, of vias (not shown in FIG. 3).

It is known, that typically only the last metallization layer is typically used for the propagation of microwaves.

In an embodiment, last metallization layer, is meant the metallization layer, usually made of copper, the furthest away from the substrate 130, in the present case, the sixth layer M6.

According to an embodiment and surprisingly, on a high resistivity substrate 130, a metallization layer other than the last layer may be used for the transport of a microwave signal. Furthermore, many layers may be used to this end, by electrically connecting them together, for example, by means of vias 230.

Contrary to conventional thinking (see, e.g., A. M. Mangan, S. P. Voinigescu, M. T. Yang, and M. Tazlauanu, "De-Embedding Transmission Line Measurements for accurate Modeling of IC Designs," IEEE Trans. Electron. Dev., Vol. ED-53, pp.235-241, No. 2, 2006 which is incorporated by reference), the use of a layer lower than the last metallization layer for the propagation of a microwave on a high resistivity substrate may not increase the parasitic capacitance with respect to the substrate.

In the non-limiting example shown in FIG. 3, only the first, second, and third metallization layers, respectively M1, M2, and M3, are coupled together by means of vias 230 such that together these three layers may carry a microwave signal.

In another embodiment, one single metallization layer, possibly other than the last layer, may be used for the transport of a microwave signal. In the present embodiment, one of the metallization layers M1 to M6.

In other embodiments, other combinations of layers may be used for the transport of a microwave signal. Embodiments comprise all possible combinations of metallization layers, from two or more layers, to the use of all metallization layers.

The supply of the metallization layers used for the transport a microwave signal may be ensured by the supply layer ALIM.

The combination of layers used may be determined according to the possibility to use, or not use, highly resistive substrates, as well as by constraints of integration with other components or of routing (e.g., the necessity to leave a metal level available for other connections).

An embodiment of the invention may be carried out in the microwave field, particularly for the achievement of filters at 90 GHz.

An embodiment of a coplanar waveguide device such as described above may be part of an electronic system, such as a microwave communication system.

Naturally, in order to satisfy local and specific requirements, a person skilled in the art may apply to the embodiments described above many modifications and alterations. Particularly, although one or more embodiments have been described with a certain degree of particularity, it should be understood that various omissions, substitutions, and changes in the form and details as well as other embodiments are possible. Moreover, it is expressly intended that specific elements and/or method steps described in connection with any disclosed embodiment may be incorporated in any other embodiment as a general matter of design choice.

What is claimed is:

1. A coplanar microwave waveguide electronic device; comprising:

a substrate;

a central signal ribbon including a plurality of metallization layers; and at least one ground plane including said plurality of metallization layers;

wherein the ground plane and central signal ribbon on a same metallization layer are configured to support propagation of a microwave signal; and wherein each metallization layer of the central signal ribbon includes a plurality of individual signal lines that are electrically connected together.

2. The device according to claim 1, wherein a total width covered by the plurality of individual signal lines is greater than the maximal width that could be given to a unique individual signal line without loss of flatness.

3. The device according to claim 1, wherein a gradient of metallic density of the ground plane comprises increases from the central signal ribbon towards a periphery of the ground plane.

4. The device according to claim 1, wherein a gradient of metallic density of the ground plane comprises decreases from the central signal ribbon towards a periphery of the ground plane.

5. The device according to claim 1, wherein the substrate is a high resistivity substrate.

6. The device according to claim 1, wherein the substrate is a high-resistivity substrate, and wherein the ground plane and central signal ribbon on at least two metallization layers are configured to support propagation of the microwave signal.

7. The device according to claim 1, wherein the substrate is a high-resistivity substrate, and wherein the ground plane and central signal ribbon on all metallization layers are configured to support propagation of the microwave signal.

8. The device according to claim 1, wherein the same metallization layer is a metallization layer closest to the substrate.

9. The device according to claim 1, wherein the ground plane comprises an electrically conducting material including a plurality of holes.

10. The device according to claim 9, wherein the holes are arranged in lines parallel to the central signal ribbon.

11. A coplanar microwave waveguide electronic device; comprising:

a substrate whereon is mounted a central signal ribbon and at least one ground plane;

said ground plane including a plurality of metallization layers;

wherein said central signal ribbon is also achieved as a plurality of metallization layers, at least one metallization layer of the ground plane being able to cooperate with a same-level layer of the central signal ribbon for the propagation of a microwave signal; and wherein each metallization layer of the central signal ribbon is operable to propagate a microwave signal and includes a plurality of individual signal lines electrically connected together for the propagation of said microwave signal.

12. The device according to claim 11, wherein the total width covered by the plurality of individual signal lines is greater than the maximal width that could be given to a unique individual signal line without loss of flatness.

13. The device according to claim 11, wherein the substrate is a high resistivity substrate, and wherein the ground plane and the central signal ribbon comprise a plurality of metallization layers any one of which is operable to carry a microwave signal.

14. The device according to claim 11, wherein at least the metallization layer closest to the substrate of the ground plane is operable to cooperate with the metallization layer closest to the substrate of the central signal ribbon to propagate the microwave signal.

15. The device according to claim 11, wherein the ground plane comprises an electrically conducting material and comprises a plurality of holes.

16. The device according to claim 15, wherein the holes are spread over lines parallel to the central signal ribbon, each parallel line with holes comprising identical holes.

17. The device according to claim 11, wherein the ground plane comprises a gradient of metallic density from the central signal ribbon towards a periphery of the ground plane.

18. The device according to claim 17, wherein the gradient of metallic density decreases from the central signal ribbon towards the periphery of the ground plane.

19. The device according to claim 11, wherein the substrate is a high-resistivity substrate, and wherein the ground plane and the central signal ribbon comprise a plurality of metallization layers at least any two metallization layers of which are electrically connected together to propagate a microwave signal.

20. The device according to claim 19, wherein all metallization layers are electrically connected together to propagate a microwave signal.

* * * * *